United States Patent [19]

Bushee

[11] 4,253,214

[45] Mar. 3, 1981

[54] FINISH WORK TROWEL

[76] Inventor: Richard Bushee, 19 Grove St., Wakefield, Mass. 01880

[21] Appl. No.: 65,954

[22] Filed: Aug. 13, 1979

[51] Int. Cl.[3] ..... B05C 17/10

[52] U.S. Cl. ..... 15/235.4

[58] Field of Search ..... 15/235.4, 235.5, 235.7, 15/235.8, 245, 105, 235.6

[56] References Cited

U.S. PATENT DOCUMENTS

| | | | |
|---|---|---|---|
| 38,044 | 3/1863 | Howe | 15/235.4 |
| 2,952,028 | 9/1960 | Robbins | 15/235.4 |
| 3,676,888 | 7/1972 | Akers | 15/245 |
| 3,686,703 | 8/1972 | Ray | 15/235.4 |
| 3,878,581 | 4/1975 | Perna | 15/235.7 |

*Primary Examiner*—Edward L. Roberts

*Attorney, Agent, or Firm*—Wolf, Greenfield & Sacks

[57] ABSTRACT

A plasterers trowel designed for finished coats of plaster consisting of an elongated flat rectangular rigid base plate with an elongated handle secured at one end only to the base plate. A flexible resilient essentially non-compressible trowel blade with a smooth lower surface and thickness in the order of ⅛" is secured to the base plate. The trowel blade is formed with a feathered knife edge at its periphery with the periphery of the trowel blade extending beyond the periphery of the base plate.

2 Claims, 3 Drawing Figures

FINISH WORK TROWEL

BACKGROUND OF THE INVENTION

Plastering walls may involve either the application of a textured surface to the plastered wall, often referred to as float work, or forming a smooth wall surface without marks or texturing of any type, often referred to as finish work. Heretofore, tools have been especially designed for float work, but few have been especially designed for finish work. Float work tools or floats heretofore designed frequently provide specially formed blades to assist in creating a textured surface, while conventional finish work trowels are formed with flat rectangular rigid steel blades. There are also other differences between float and finish trowels.

In float work, the texturing applied to the surface of the plastered wall is achieved by rotating the trowel in a circular movement. The trowel is generally held flat against the wall and is moved in a circular motion. Trowels that are normally used for this float work are optimally designed with handles secured to the trowel blade at both ends. Such float trowels are not designed or intended for use on finished work.

Finished work trowels, on the other hand, are designed with handles which are secured only at one end to the base plate of the trowel. By securing the handle only at one end, the trowel may be rotated more readily about an axis parallel to the handle in a feathering motion during plastering. In finished work, unlike the float work, the flat portion of the trowel is not always held against the wall but is rotated away from it at the end of the stroke to achieve a feathered edge and to blend the end of the section of plaster being applied to adjacent portions of plaster.

Because of the motion by which finish work is achieved, the metal, non-resilient edges of conventional finish work trowels are not ideally suited for such finish work. Limitations on trowels heretofore available for finish work has been accented by further developments in plastering materials which are now currently in common use. Previously a rock lathe with a base gypsum coat was first formed when making a plastered wall. As a rule, several days later a lime finish coat was applied. When a lime finish coat was used, moisture would be readily sucked into the previously dried gypsum coat. The quick drying of the lime coat permitted a quick set with little feathering problems, since the finished coat of plaster became hard quite quickly. For that reason, there was no serious need for the plasterer to feather the edge of the stroke with any great care. More recently, plaster walls are formed using a one-coat system in which a single layer of plaster is applied over a base layer or blue board. The single layer of plaster is applied while still quite wet. Unless the plasterer is quite careful, a mark is left at the end of each trowel motion. This requires great skill and care by the plasterer. It further requires a careful feathering motion.

SUMMARY OF THE INVENTION

It is an object of the present invention to provide an improved finish work trowel which permits a plasterer to apply plaster to a base wall or other surface with ease and minimum of skill to achieve a smooth finish surface. A further object of the present invention is to provide an improved trowel designed for finish work, which trowel is sturdy in construction, simple in design and capable of being used in a conventional manner.

The foregoing objects and advantages of the present invention are achieved in a finish work trowel which consists essentially of a flat metal rigid base plate to which is secured a trowel blade formed of a flexible resilient essentially non-compressible material with a smooth lower surface. This blade is designed with a thickness in the order of ⅛" and with a feathered or knife edge at its periphery extending beyond the periphery of the base plate. A finish work trowel handle is secured to the base plate with its handle being secured at one end only to the base plate.

BRIEF DESCRIPTION OF THE DRAWINGS

The foregoing objects and advantages of the present invention will be more clearly understood when considered in conjunction with the accompanying drawings in which.

DETAILED DESCRIPTION OF THE PREFERRED EMBODIMENTS

Figure 1:
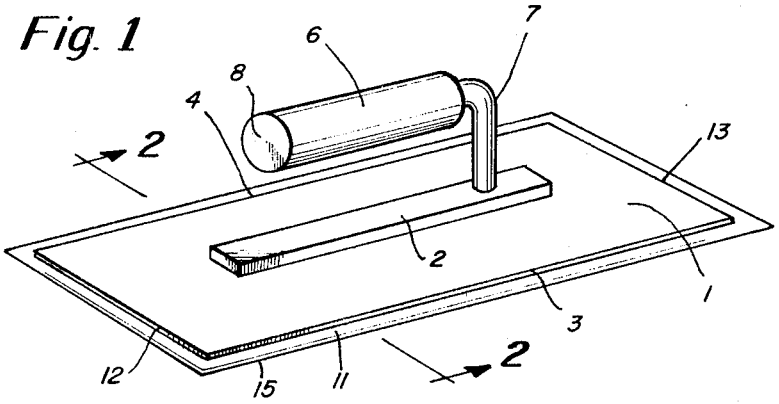
FIG. 1 is a perspective view of a finish work trowel embodying the preferred invention.

The trowel shown in the drawings illustrates the preferred embodiment of the present invention. It includes a rectangular base plate 1 made of metal and preferably having a width dimension of approximately 2½" or more, a length dimension of approximately 8" or more and a thickness in the order of 1/16". This metal base plate is rigid and sturdy and should not flex or bend. Secured to the upper surface of this base plate 1 is a reinforcing bar 2 preferably welded or otherwise suitably and permanently secured to the upper surface of the plate 1. The bar 2 extends parallel to the side edges 3 and 4 of the base plate and is intermediate between them. The reinforcing bar may extend more than half the length of the plate 1. A handle 6 is supported parallel to the bar 2 as illustrated and is secured to it by a support arm 7 with the support arm 7 secured at one end to the bar 2 and at the other end to one end of the handle 6. The other end 8 of the handle 6 is spaced from the plate 1. The support bar 7 secures the handle 6 a sufficient distance from the bar 2 as to permit one to grip the handle 6 to move the trowel with a rocking or rolling motion at the end of a stroke.

Figure 2:
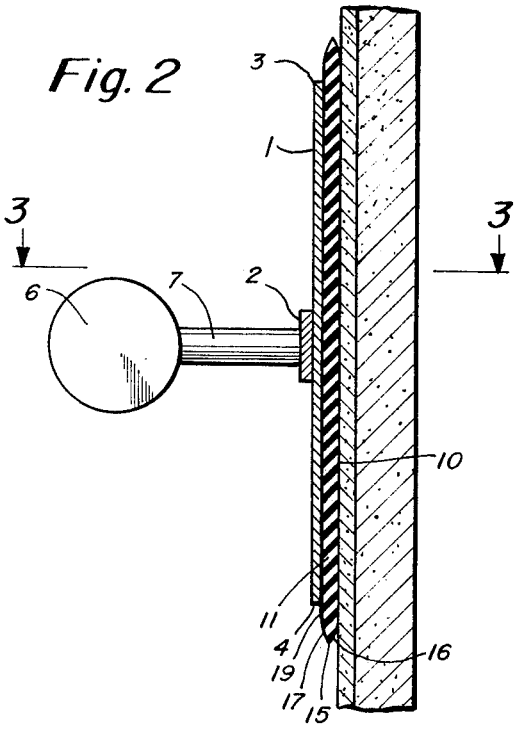
FiG. 2 is a cross-sectional enlarged view of a trowel embodying the present invention, taken along the line 2—2 of FIG. 1; and, FIG. 3 is a cross-sectional view taken along the line 3—3 of FiG. 2.
Figure 3:
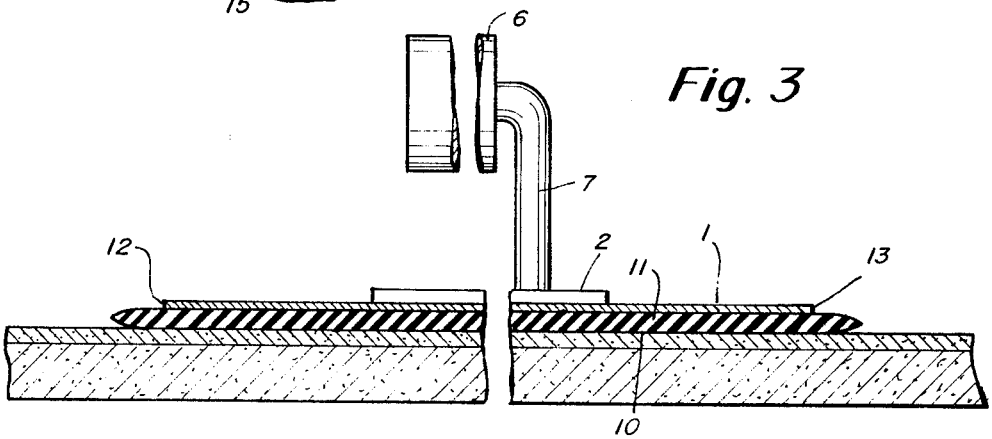

The plate 1 has secured to its lower surface by cement or other suitable securing means a rubber or rubber-like trowel blade 10. This trowel blade 10 is preferably formed of a comparatively hard rubber to provide a flexible resilient and essentially non-compressible blade with a smooth lower surface 11. The side and end edges of the rectangular blade 10 extend beyond the side and end edges 3, 4, 12 and 13 of the plate 1, preferably a uniform distance in the order of magnitude of about a half an inch. The blade 10 is formed with its peripheral end and side edges feathered to a knife edge, best illustrated in Fig. 2 at 15, with the bevels 16 and 17 preferably slightly curved and symmetrically formed with respect to the edge 15.

The blade 10 may vary in thickness but preferably should be in the order of ⅛" thick so as to permit the peripheral margin 19 formed between the edge 5 of the blade and the edges of the plate to flex somewhat. This slight flexing permits the plasterer to feather the edge as he rotates the finish trowel from the work surface at the end of a stroke.

The invention also contemplates means for modifying presently existing finishing trowels to provide an improved finished trowel construction. In this modification of the invention, a finished trowel formed with a rectangular base plate of metal with a handle connected to its upper surface has a flexible, essentially non-compressible pad of rubber or rubber-like material secured to it by an adhesive layer. The rubber pad should have an outer dimension which is approximately one inch greater in both width and length than the rectangular outer dimension of the base plate, so as to allow approximately a half inch border of the pad beyond the periphery of the base plate. The pad is formed with a feathered knife edge. A pressure-sensitive adhesive may be applied to the lower portion of the base plate or the upper surface of the pad to secure the pad to the base plate. In commercial embodiments, the pressure-sensitive adhesive would be applied to the flexible pad in an appropriate area and covered with a strippable material such as paper until the pad is to be secured to a finished trowel.

This trowel also can be used very effectively using joint compound, a material that bonds to any type of surface painted or otherwise.

Much in the same manner as one coat plaster the rubber edges leave no marks and where two or three applications are required, even though the surface is not perfectly straight or level, the resiliency of the rubber edge leaves no trowel marks and leaves a very satisfactory job.

The average person can use this trowel and be pleased with its results using joint compound.

I claim:

1. A finish work trowel for applying finish coats of plaster comprising:

an elongated flat metal, rectangular, rigid base plate having a length of at least 8 inches and a width of at least 2½ inches, a flexible, resilient, essentially non compressible trowel blade having a smooth lower surface, said blade having a uniform thickness in the order of ⅛ inch and a feathered edge forming its periphery, said blade edge extending uniformly beyond the entire perimeter of said plate a distance of approximately ½ inch from said plate perimeter, means securing the upper surface of said blade to the bottom of said base plate, an elongated handle and means securing said handle at one end only to said base plate, said elongated handle being parallel to the length of said base plate and said means securing said handle comprises an elongated reinforcing bar rigidly secured to the upper surface of said base plate and a support arm connected at one end to said reinforcing bar and at the other end to one end of said elongated handle supporting said elongated handle parallel to said base plate.

2. In a finish work trowel for applying finish coats of plaster, said work trowel of the type having an elongated flat rectangular rigid base plate and a handle secured to the top surface of said base plate, the improvement comprising, a flexible, resilient essentially non compressible rubber trowel blade attachable to the bottom surface of the base plate by a pressure sensitive adhesive, said trowel blade having a uniform thickness in the order of about ⅛ inch and a feathered edge forming its periphery, said blade upon attachment to the base plate extends uniformly beyond the entire perimeter of said plate a distance of approximately ½ inch from said plate perimeter.

* * * * *